United States Patent [19]

Heberling et al.

[11] 4,350,393

[45] Sep. 21, 1982

[54] PLOUGH TRANSMISSION

[75] Inventors: Walter Heberling; Wolfgang Muller, both of Lunen; Werner Langenberg, Werne; Gerhard Behrens, Bergkamen; Alfred Saul, Lunen, all of Fed. Rep. of Germany

[73] Assignee: Gewerkschaft Eisenhutte Westfalia, Lunen, Fed. Rep. of Germany

[21] Appl. No.: 167,186

[22] Filed: Jul. 9, 1980

[30] Foreign Application Priority Data

Jul. 17, 1979 [DE] Fed. Rep. of Germany ..... 2928789

[51] Int. Cl.[3] ..... E21C 27/32

[52] U.S. Cl. ..... 299/50; 299/34

[58] Field of Search ..... 299/34, 42, 43, 50

[56] References Cited

U.S. PATENT DOCUMENTS 3,335,622 8/1967 Heberling et al. ..... 299/34

4,159,851 7/1979 Rösler ..... 299/34

*Primary Examiner*—William F. Pate, III

*Attorney, Agent, or Firm*—Sughrue, Mion, Zinn, Macpeak & Seas

[57] ABSTRACT

A transmission for transmitting drive from a motor to a drive sprocket wheel for driving the drive chain of a mineral mining plough has a housing which is attached to a side plate of the drive frame of a mine conveyor. The housing is formed with a recess sized and shaped to accommodate the sprocket wheel. The recess is open at one end to permit the plough drive chain to enter and leave the sprocket wheel. The housing is provided with connector flanges adjacent to the end remote from the recess opening, and with a spacer adjacent to the end adjacent to the recess opening. The spacer is detachably secured to the housing and to the drive frame, or to an intermediate channel section which joins the drive frame to a scraper-chain conveyor. The spacer and the flanges are bolted to the drive frame and/or the channel section.

14 Claims, 4 Drawing Figures

PLOUGH TRANSMISSION

BACKGROUND TO THE INVENTION

This invention relates to a transmission for transmitting drive from a motor to a drive sprocket wheel for driving the drive chain of a mineral mining plough which is movable along a scraper-chain conveyor.

A scraper-chain conveyor is constituted by a plurality of channel sections, which are joined together end-to-end, and a scraper assembly which is circulated round the channel sections. At each end, the conveyor has a drive station having a drive frame, which contains a sprocket drum for driving or reversing the scraper assembly, and an intermediate channel section for connecting the drive frame to the adjacent conveyor channel section. When a plough is used for winning mineral material, the plough is driven, via an endless drive chain, by means of a sprocket wheel positioned laterally of the drive frame.

It is known for the plough drive sprocket wheel to be housed in a casing (a so-called plough box) which is attached to the drive frame. In this case, the plough transmission housing is flanged to the side of the plough box. The disadvantage of this type of arrangement is that it requires a separate member (the plough box) to house the sprocket wheel, and this leads to additional expense, as well as a complicated assembly process. An arrangement of this type is described in DE-Gbm 72 23542.

In another known arrangement, this disadvantage is overcome by dispensing with the plough box. In this case, the housing of the plough transmission is provided with integral connector flanges which are bolted directly onto the adjacent side plate of the drive frame. The disadvantage of this arrangement is that the entire reaction forces are absorbed by the connector flanges and their bolts, which leads to a considerable (and undesirable) stressing of these connections and also of the transmission housing. An arrangement of this type is described in DE-Gbm No. 66 00002.

SUMMARY OF THE INVENTION

The present invention provides a transmission for transmitting drive from a motor to a drive sprocket wheel for driving the drive chain of a mineral mining plough, the transmission having a housing which is attachable to a side plate of a mine conveyor drive station, the housing being formed with a recess sized and shaped to accommodate the sprocket wheel, the recess being open at one end to permit the plough drive chain to enter and leave the sprocket wheel, and the housing being provided with attachment means adjacent to each end thereof for attaching the housing to said drive station side plate, wherein the attachment means adjacent to said recess opening is constituted by a spacer which is detachably secured to the housing, and which is detachably securable to said drive station side plate.

The spacer forms a bridge which supports the chain entry end of the transmission housing firmly against the drive frame or the intermediate channel section. The attachment means adjacent to the other end of the housing completes an attachment arrangement of a particularly firm kind, and which avoids excessive stressing of the housing and the attachment means.

Advantageously, the attachment means adjacent to the housing end remote from said recess opening is constituted by at least one flange, and preferably by two flanges.

Preferably, the spacer is provided with guide surfaces for guiding the plough drive chain onto, and away from, the sprocket wheel. In this case, the spacer acts as a chain guide as well as a bridge for connecting the transmission housing to the drive station. Conveniently, the spacer is generally wedge-shaped, the thinner end of the wedge-shaped spacer pointing away from said recess opening. Advantageously, the spacer is provided with at least one detachable tongue. Usually, the spacer will have two such tongues, one of which acts as a chain stripper for lifting the chain links away from the sprocket wheel as the chain leaves the sprocket wheel. The other tongue acts as an additional guide for positioning the chain links on the sprocket wheel.

Conveniently, the spacer is provided with an integrally-formed attachment plate which is detachably secured to the housing. Advantageously, the spacer is non-rotatably secured to the housing, and the spacer is provided with means for securing the spacer non-rotatably to said drive station side plate. Preferably, the spacer is non-rotatably secured to the housing by a key-and-slot connection, and wherein the spacer is provided with a key which forms part of a key-and-slot connection for non-rotatably securing the spacer to said drive station side plate.

The invention also provides a drive station for a mine conveyor, the drive station having a pair of parallel side plates, a sprocket wheel for driving the drive chain of a mineral mining plough, the sprocket wheel being mounted adjacent to one of the side plates, and a drive for driving the sprocket wheel, the drive including a transmission, the transmission being as defined above.

In one preferred embodiment, the sprocket wheel is mounted within the recess in the transmission housing. Alternatively, the transmission housing is detachably secured to the side plate of the drive station which is remote from the sprocket wheel, the sprocket wheel being mounted on an output shaft of the plough transmission, and the output shaft passing through both side plates of the drive station. In this case, the upper side of the recess in the housing is covered by a detachable hood.

BRIEF DESCRIPTION OF THE DRAWINGS

Two forms of mineral mining installation, each incorporating a plough transmission constructed in accordance with the invention, will now be described, by way of example, with reference to the accompanying drawings, in which.

DESCRIPTION OF PREFERRED EMBODIMENTS

Figure 1:
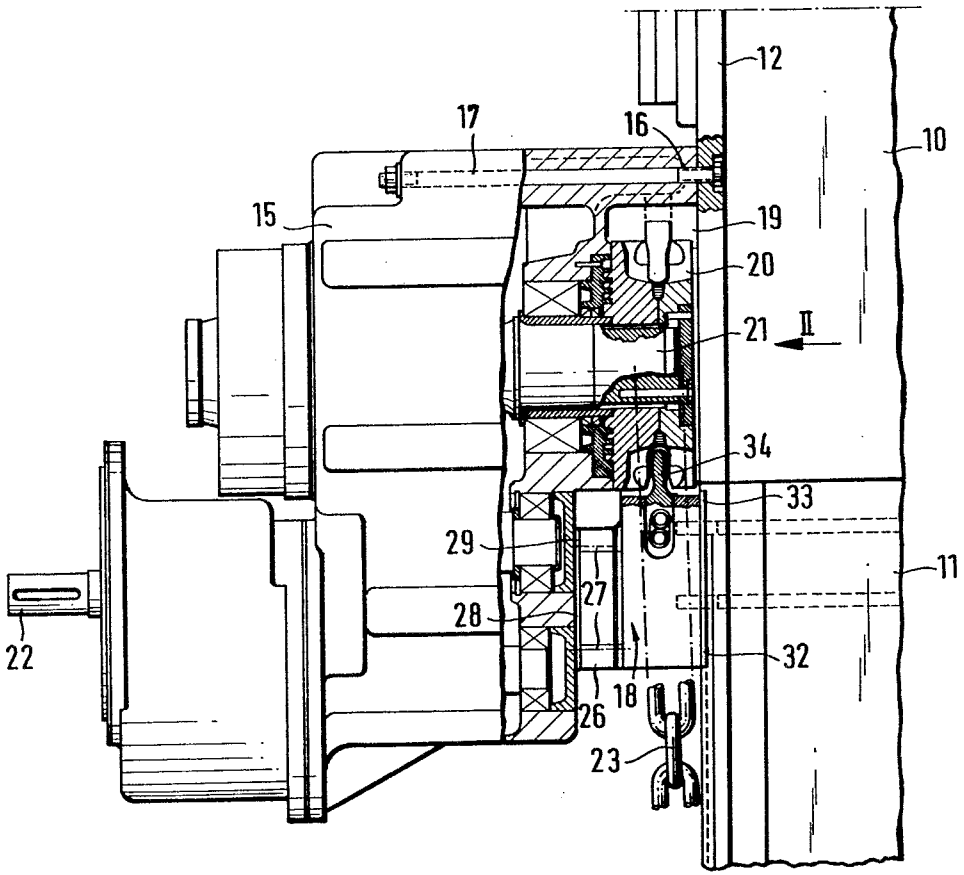
FIG. 1 is a part-sectional plan view of the first form of installation, ans shows a plough transmission and part of one end of a scraper-chain conveyor.
Figure 4:
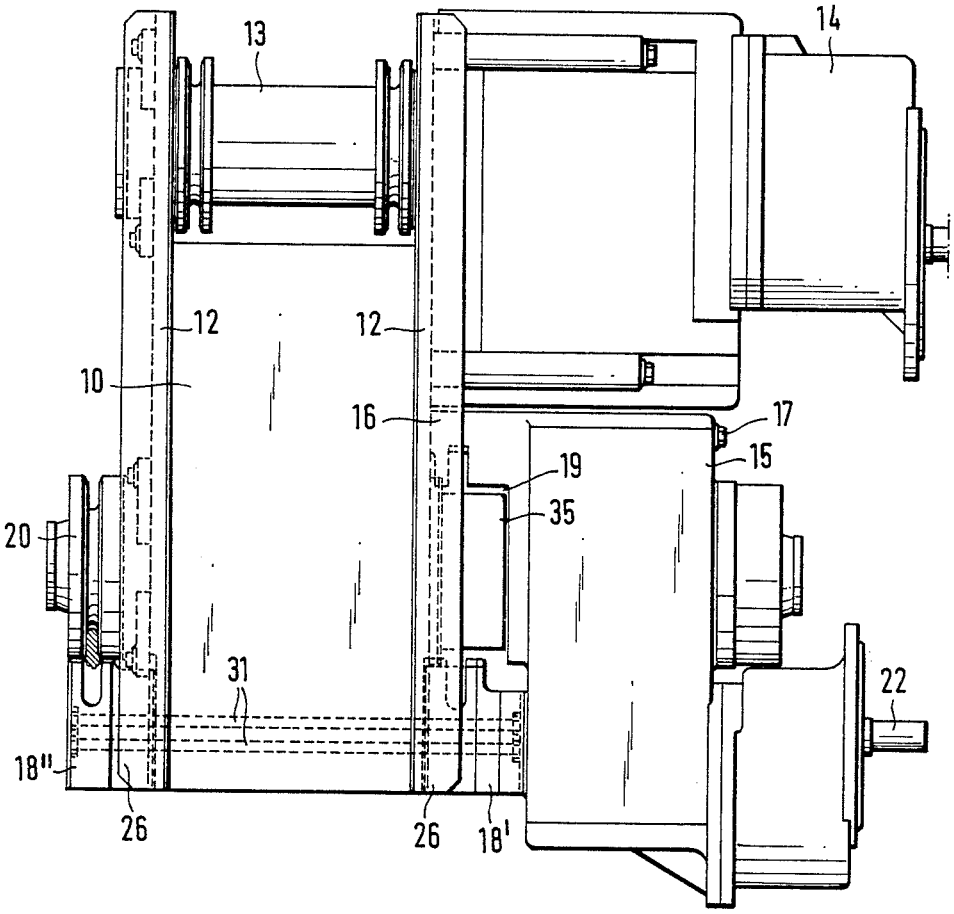
FIG. 4 is a plan view of the second form of installation, and shows a plough transmission and one end of a scraper-chain conveyor.

Referring to the drawings, FIG. 1 shows a drive frame 10 of a scraper-chain conveyor, the drive frame being connected to the channel sections (not shown) of the conveyor by an intermediate channel section 11. The drive frame 10 and intermediate channel section 11 form part of a drive station for driving both the conveyor and a plough (not shown) which is movable to and fro along the conveyor at the face side thereof. The drive frame 10 has a pair of parallel side plates 12 (only one of which can be seen in FIG. 1). In the arrangement of FIG. 1, the plough is driven, via a plough drive chain 23, by means of a sprocket wheel 20 mounted adjacent to the goaf-side side plate 12 of the drive frame 10. In the arrangement of FIG. 4, however, the sprocket wheel 20 is mounted adjacent to the face-side side plate 12 of the drive frame 10. In other respects, the arrangements of FIGS. 1 and 4 are very similar. In particular, the two side plates 12 support a sprocket drum 13 (see FIG. 4) which is used to drive the scraper assembly (not shown) of the conveyor. The sprocket drum 13 is provided with a drive 14 which is flanged to the goaf-side side plate 12 of the drive frame.

Figure 2:
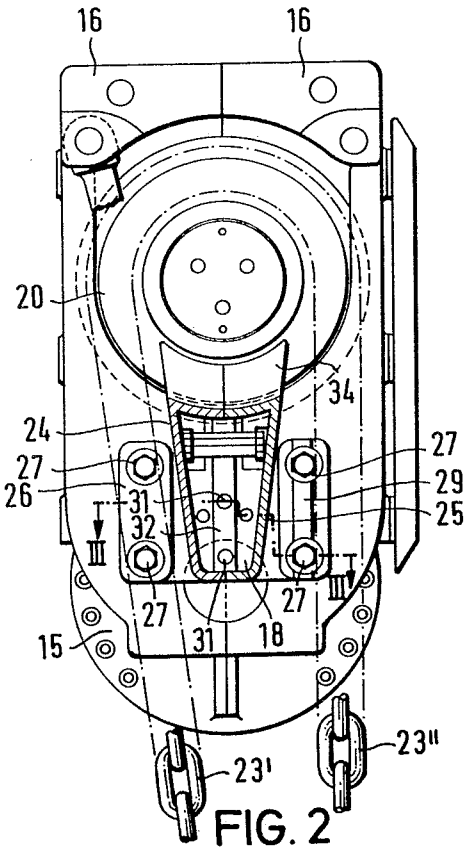
FIG. 2 is a view looking in the direction of the arrow II of FIG. 1.
Figure 3:
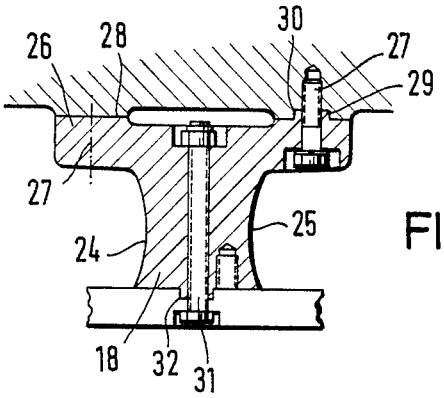
FIG. 3 is a cross-section taken on the line III—III of FIG. 2.

Referring to FIGS. 1 to 3, the sprocket wheel 20 is driven by a plough drive (not shown) which is flanged to the housing 15 of a plough transmission on the goaf side of the drive frame 10. The sprocket wheel 20 is mounted within a recess 19 in the housing 15, the recess 19 being open at one end to permit the drive chain 23 to enter and leave the sprocket wheel. The sprocket wheel 20 is mounted on a shaft 21 which constitutes the drive output shaft of the plough transmission. The transmission has an input shaft 22 which is coupled to a drive motor such as an electric motor. At the end of the housing 15 remote from the recess opening, a pair of connector flanges 16 are provided. The flanges 16 are integrally formed with the housing 15 and bear against the goaf-side side plate 12 of the drive frame 10. Bolts 17 are used to attach the flanges 16 firmly to the adjacent side plate 12. This two-point connection prevents this end of the spacer 18 from rotating relative to the drive frame 10.

At the opposite end (that is to say at the end adjacent to the recess opening), the housing 15 is supported against the side plate of the intermediate channel section 11 by means of a spacer 18. Alternatively, the spacer 18 could bear against the side plate 12 of the drive frame 10. The spacer 18 is formed with concave guide surfaces 24 and 25 (see FIG. 3), and the spacer is generally wedge-shaped so that the surfaces 24 and 25 diverge slightly towards the sprocket wheel 20 (see FIG. 2). The guide surfaces 24 and 25 guide the drive chain 23 onto, and away from, the sprocket wheel 20. The wedge-shaped spacer 18 is provided with an integrally-formed attachment plate 26, by means of which the spacer is detachably secured to the vertical end face 28 of the transmission housing 15 by bolts 27. The spacer 18 is prevented from rotating relative to the transmission housing 15, by the interengagement of a key 29 formed on the plate 26 and a slot 30 formed in the end face 28.

The spacer 18 is detachably secured to the side plate of the intermediate channel section 11 by means of bolts 31, and the spacer is prevented from rotating relative to the intermediate channel section by the interengagement of a key 32 formed on the spacer and a slot 33 formed in the side plate. Accordingly, the transmission housing 15 is firmly and non-rotatably secured to the drive frame 10 and the intermediate channel section 11, the sprocket wheel 20 being positioned between the two areas of connection.

As best seen in FIG. 2, the spacer 18 (which is positioned between the upper and lower runs 23' and 23'' respectively of the plough drive chain 23) is provided with detachable tongues 34. The tongues 34 are profiled to engage within the circumferential groove of the sprocket wheel 20, one of the tongues acting as a chain stripper to lift the chain links out of engagement with the teeth of the sprocket wheel, and the other tongue acting as a guide for guiding the chain links into engagement with the teeth. As the tongues are detachable, they are easily replaceable when worn.

In the embodiment of FIGS. 1 to 3, the plough drive chain 23 runs along the goaf side of the conveyor, so that the sprocket wheel 20 is mounted on the same side of the conveyor as the plough transmission. In the embodiment of FIG. 4, however, the plough drive chain (not shown) runs along the face side of the conveyor, so that the sprocket wheel 20 is mounted on the opposite side of the conveyor to the plough transmission. In this case the output shaft (not shown) of the plough transmission is extended so as to pass through the drive frame 10, the sprocket wheel 20 being mounted on the free end of the output shaft. The recess 19 within the trasmission housing 15 (which in the embodiment of FIGS. 1 to 3 accommodates the sprocket wheel 20) is here covered by a detachable hood 35. The spacer 18' of the FIG. 4 embodiment does not need to have a chain guide function, and so can be a simple spacer which is detachably, and non-rotatably, secured to the housing 15 and the side plate 12 of the drive frame 10 in a manner similar to that described above with reference to the spacer 18 of FIGS. 1 to 3.

A chain guide member 18'' is attached to the face-side side plate 12 of the drive frame 10 in the region of the sprocket wheel 20. This guide member 18'' is similar to the spacer 18 of the embodiment of FIGS. 1 to 3 in that it has guide surfaces and tongues (not shown). The spacer 18' and the guide member 18'' are detachably secured to the drive frame 10 by means of bolts 31 which pass right through the drive frame and through their attachment plates 26.

As with the embodiment of FIGS. 1 to 3, the other end of the transmission housing 15 is attached to the goaf-side plate 12 of the drive frame 10 by means of a pair of flanges 16. Alternatively, a single continuous flange could take the place of the pair of flanges 16.

We claim:

1. A transmission for transmitting drive from a motor to a drive sprocket wheel for driving a drive chain of a mineral mining plough, the transmission having a housing which is directly attached to a side plate of a mine conveyor drive station, the housing being formed with a recess sized and shaped to accomodate the sprocket wheel, the recess being open at one end to permit the plough drive chain to enter and leave the sprocket wheel, and the housing being provided with attachment means adjacent to each end thereof for attaching the housing to said drive station side plate, wherein the attachment means adjacent to the housing end adjacent to said recess opening is a spacer which is detachably secured to the housing, and which is detachably securable to said drive station side plate, and wherein the attachment means adjacent to the housing end remote from said recess opening is constituted by at least one flange formed integrally with said housing, said at least one flange being directly attached to said drive station side plate.

2. A plough transmission according to claim 1, wherein the attachment means adjacent to the housing end remote from said recess opening is constituted by two flanges.

3. A plough transmission according to claim 1, wherein the spacer is provided with an integrally-formed attachment plate which is detachably secured to the housing.

4. A plough transmission aaccording to claim 1, wherein the spacer is non-rotatably secured to the housing, and the spacer is provided with means for securing the spacer non-rotatably to said drive station side plate.

5. A plough transmission according to claim 4, wherein the spacer is non-rotatably secured to the housing by a key-and-slot connection, and wherein the spacer is provided with a key which forms part of a key-and-slot connection for non-rotatably securing the spacer to said drive station side plate.

6. A plough transmission according to claim 1, wherein the spacer is provided with guide surfaces for guiding the plough drive chain onto, and away from, the sprocket wheel.

7. A plough transmission according to claim 6, wherein the spacer is generally wedge-shaped, the thinner end of the wedge-shaped spacer pointing away from said recess opening.

8. A plough transmission according to claim 1, wherein the spacer is provided with at least one detachable tongue.

9. A drive station for a mine conveyor, the drive station having a pair of parallel side plates, a sprocket wheel for driving a drive chain of a mineral mining plough, the sprocket wheel being mounted adjacent to one of the side plates, and a drive for driving the sprocket wheel, the drive including a transmission, and the transmission having a housing which is attached directly to said one side plate, the sprocket wheel being mounted within a recess formed in the transmission housing, the recess being open at one end to permit the plough drive chain to enter and leave the sprocket wheel, and the housing being provided with attachment means adjacent to each end thereof attaching the housing to said one side plate, wherein the attachment means adjacent to the housing end adjacent to said recess opening is a spacer detachably secured to the housing and to said one side plate, and wherein the attachment means adjacent to the housing end remote from said recess opening is constituted by at least one flange formed integrally with said housing, said at least one flange being directly attached to said drive station side plate.

10. A drive station for a mine conveyor, the drive station having a pair of parallel side plates, a sprocket wheel for driving a drive chain of a mineral mining plough, the sprocket wheel being mounted adjacent to one of the side plates, and a drive for driving the sprocket wheel, the drive including a transmission, and the transmission having a housing which is attached to the other side plate, the sprocket wheel being mounted on an output shaft of the plough transmission, and the output shaft passing through both side plates of the drive station, wherein a recess is formed within the housing, the recess being open towards one end of the housing, and the housing being provided with attachment means adjacent to each end thereof attaching the housing to said other side plate, and wherein the attachment means adjacent to said one end of the housing is a spacer detachably secured to the housing and to said other side plate.

11. A plough transmission according to claim 11, wherein the upper side of the recess in the housing is covered by a detachable hood.

12. A transmission for transmitting drive from a motor to a drive sprocket wheel for driving a drive chain of a mineral mining plough, the transmission having a housing which is attachable to a side plate of a mine conveyor drive station, the housing being formed with a recess sized and shaped to accomodate the sprocket wheel, the recess being open at one end to permit the plough drive chain to enter and leave the sprocket wheel, and the housing being provided with attachment means adjacent to each end thereof for attaching the housing to said drive station side plate, wherein the attachment means adjacent to the housing end adjacent to said recess opening is a spacer which is detachably secured to the housing, and which is detachably securable to said drive station side plate, and wherein the spacer is non-rotatably secured to the housing, and the spacer is provided with means for securing the spacer non-rotatably to said drive station side plate.

13. A plough transmission according to claim 12, wherein the spacer is non-rotatably secured to the housing by a key-and-slot connection, and wherein the spacer is provided with a key which forms part of a key-and-slot connection for non-rotatably securing the spacer to said drive station side plate.

14. A transmission for transmitting drive from a motor to a drive sprocket wheel for driving a drive chain of a mineral mining plough, the transmission having a housing which is attachable to a side plate of a mine conveyor drive station, the housing being formed with a recess sized and shaped to accomodate the sprocket wheel, the recess being open at one end to permit the plough drive chain to enter and leave the sprocket wheel, and the housing being provided with attachment means adjacent to each end thereof for attaching the housing to said drive station side plate, wherein the attachment means adjacent to the housing end adjacent to said recess opening is a spacer which is detachably secured to the housing, and which is detachably securable to said drive station side plate, and wherein the spacer is provided with at least one detachable tongue.

* * * * *